US006766845B2

(12) United States Patent
Rejc

(10) Patent No.: US 6,766,845 B2
(45) Date of Patent: Jul. 27, 2004

(54) INDUSTRIAL GATE, DOUBLE-WALLED SEGMENT FOR AN INDUSTRIAL GATE, AND METHOD FOR MANUFACTURING SUCH A SEGMENT

(75) Inventor: Petra Rejc, Landshut (DE)

(73) Assignee: Efaflex Tor-und Sicherheitssysteme GmbH & Co. KG, Bruckberg (DE)

( * ) Notice: Subject to any disclaimer, the term of this patent is extended or adjusted under 35 U.S.C. 154(b) by 21 days.

(21) Appl. No.: 10/119,506

(22) Filed: Apr. 10, 2002

(65) Prior Publication Data

US 2002/0195596 A1 Dec. 26, 2002

(30) Foreign Application Priority Data

Apr. 19, 2001 (DE) ..... 101 19 240

(51) Int. Cl.[7] ..... E06B 9/08
(52) U.S. Cl. ..... 160/133; 160/232
(58) Field of Search ..... 160/133, 201, 160/229.1, 232, 236, 235

(56) References Cited

U.S. PATENT DOCUMENTS

| | | | | |
|---|---|---|---|---|
| 1,910,047 A | | 5/1933 | Passoni | |
| 4,183,393 A | * | 1/1980 | Bailey | 160/232 |
| 4,569,383 A | | 2/1986 | Wentzel | |
| 4,748,783 A | | 6/1988 | Labelle | |
| 5,002,114 A | * | 3/1991 | Hormann | 160/229.1 |
| 5,170,832 A | * | 12/1992 | Wagner | 160/232 X |
| 5,394,924 A | | 3/1995 | Rejc | |
| 5,484,007 A | | 1/1996 | Rejc | |
| 5,488,982 A | | 2/1996 | Rejc | |

FOREIGN PATENT DOCUMENTS

| | | | |
|---|---|---|---|
| DE | 32 42614 C2 | 11/1982 | E04H/15/64 |
| DE | 38 28 663 A1 | 8/1988 | E06B/9/16 |
| DE | 40 15 214 A1 | 5/1990 | E06B/9/08 |
| DE | 40 15 215 A1 | 5/1990 | E06B/9/08 |
| DE | 40 15 216 A1 | 5/1990 | E06B/9/08 |
| GB | 2 209 789 A | 5/1989 | E06B/9/14 |

* cited by examiner

*Primary Examiner*—David Purol
(74) *Attorney, Agent, or Firm*—Cohen, Pontani, Lieberman & Pavane

(57) ABSTRACT

An industrial gate having a gate body covering the gateway and comprising a multiplicity of segments (21) which are interconnected such that they may be oriented at a relative angle and which are formed to be double-walled, wherein the segment walls (211, 212) are interconnected at their longitudinal edges through the intermediary of a respective web (213), which web is formed of a material having a lower heat conductivity than the material of the segment walls (211, 212) so as to establish a thermal separation of the segment walls (211, 212). To this end, one substantially U-shaped profile groove (2111, 2121) each for receiving the edges of the webs (213) is formed at the longitudinal edges of the segment walls (211, 212), and one elastomer plastic element (214) each is arranged between the edges of the webs (213) and the inner surface of the profile groove (2111, 2121) in a press-fit, i.e., under deformation of the plastic element (214) in comparison with the load-free state. It is thus possible to even separate areas of clearly different room temperatures at a preserved functional safety of the industrial gate. In addition, a corresponding segment and a method for manufacturing such a segment are provided.

18 Claims, 9 Drawing Sheets

INDUSTRIAL GATE, DOUBLE-WALLED SEGMENT FOR AN INDUSTRIAL GATE, AND METHOD FOR MANUFACTURING SUCH A SEGMENT

FIELD OF THE INVENTION

The invention relates to an industrial gate having a multiplicity of segments a double-walled segment and furthermore a method for manufacturing such a segment.

BACKGROUND OF THE INVENTION

Industrial gates having a gate body covering the gateway and comprising a multiplicity of segments, or lamellae, which are interconnected such that they may be oriented at a relative angle, wherein the segments are formed to be double-walled, have been found to be excellently suited under practical conditions. They are known as fast-moving industrial gates from German patent applications DE 40 15 214 A, DE 40 15 215 A, and DE 40 15 216 A, for example. The fast-moving spiral gate described here is at the same time a burglar-proof external gate and weather-resistant fast-moving gate, to thus also be suited for frequently used closures of buildings.

Inasmuch as such external gates in many cases furthermore subdivide areas of substantially different temperatures, i.e., the range of the generally warm, heated inner space and the free external surroundings, they frequently are desired to also have heat-insulation properties. The double-walled segments which are mostly produced of aluminum, however, basically conduct heat well; for the like applications it is therefore intended to thermally separate the walls of the segments. This is practically achieved in that the segment walls are interconnected at their longitudinal edges through the intermediary of a respective web formed of a material which has a lower heat conductivity than the material of the segment walls. Frequently a GFRP (glass fiber reinforced plastic) is used as a material for the webs. For accommodating the edges of the webs, e.g., substantially dovetail-shaped grooves are formed in the range of the longitudinal edges of the segment walls, with the edges of the webs traditionally having a complementary shape. When the webs are fitted in the dovetail-shaped grooves, one groove wall is deformed with the aid of a deformation process whereby the edges of the webs are squeezed.

A thermally disconnected, double-walled segment formed in this way possesses high stability owing to the materials used and the positive engagement at the locations of connection, so that it is equally suited for fast-moving industrial gates. At the same time, a clearly reduced heat transfer across the gate body of the industrial gate is achieved through the thermal separation of the segment walls.

Under practical conditions, however, problems resulted even with such a design: Thus the reduced heat transfer within the segment had the result that the segment walls may present clearly different temperatures. This is the case, for instance, when the internal space closed off by the industrial gate is air-conditioned or refrigerated, whereas the outside of the gate body is exposed to direct insolation. The quite considerable longitudinal expansion of aluminum under thermal influences then results in a very different behavior of the internal wall compared with the external wall of the segment. This brought about a flexure of the segment in the direction of its longitudinal extension. This problem is of considerable importance particularly in the case of gate widths exceeding three meters. In particular this may also result in an impaired functional safety of the industrial gate, for segments thus bent exhibit a different behavior under the quite considerable dynamic loads in high-velocity operation than under normal conditions. Problems may possibly occur during opening of the gate, i.e., during retraction of the gate body into the spiral section in the lintel range of the gateway.

Damage may furthermore be caused to the very segment, for the GFRP web may be subjected to considerable tensions owing to its rigidly clamped condition relative to the two segment walls. In an extreme case, this may lead to fatigue of the web material, or even to destruction of a web.

This problem is further intensified if such an industrial gate is constantly subjected to such uses. This is true, for instance, for cases when continually cooled spaces, such as refrigerator rooms or the like, are closed off by the segmented gate.

SUMMARY OF THE INVENTION

The invention is therefore based on the objective of further developing a generic industrial gate in such a way that even areas of clearly different room temperatures may be separated at a preserved functional safety of the industrial gate. In addition, a corresponding segment and a method for manufacturing such a segment are to be furnished in accordance with the invention.

In accordance with a first aspect of the invention, this object is attained by an industrial gate having the features of claim 1. It is particularly characterized in that one substantially U-shaped profile groove each for receiving the edges of the webs is formed at the longitudinal edges of the segment walls, and in that one elastomer plastic element each is arranged between the edges of the webs and the inner surface of the profile groove in a press-fit, i.e., under deformation of the plastic element in comparison with the load-free state.

Here it was found in accordance with the invention that the problem of a flexure of the segments due to the different expansion of the segment walls may be mitigated in that the coupling of the webs to the segment walls is designed, other than in the prior art, such that a displacement of the segment walls relative to the webs is possible to a certain extent. Based on this insight, it was surprisingly found in the course of the invention that this may be achieved, at comparatively low expense, by the intermediate arrangement of an elastomer plastic element under lasting deformation at the locations of connection. In contrast with the prior art, a double-walled segment designed in such a way no longer constitutes a rigid structure but admits the necessary compensatory movements.

At the same time, however, it was also found entirely surprisingly that this type of connection is furthermore suited for forming a segment which is stable in itself and suffices the demands and particularly the dynamic demands to high-velocity operation of the industrial gate. The manner of connecting the segment walls by means of the webs in accordance with the invention therefore allows for a cohesion of the single elements of the segment such that the latter will furthermore be burglar-proof.

Here it was found in the framework of the invention that surprisingly even press-fitting an elastomer plastic element between the edges of the web and the inner surface of the respective profile groove is sufficient for generating the necessary retaining forces, i.e., enable a reliable connection of the members. Here the elastomer plastic element acts as a kind of "spring"; specific examinations showed that it stretches when the insert panel is pressed into the U-shaped profile groove, to then contract again when insertion is complete.

It is another advantage of the invention that hereby a substantially greater freedom of construction is provided with regard to choice of a material for the web, so that even materials having a lower heat conductivity than GFRP may be employed. Hereby the insulating effect of the segment and thus of the entire gate body of the industrial gate may be improved further. This expands the possibilities of use for the industrial gate in accordance with the invention, in particular also in the field of climate-controlled spaces.

At the same time, the industrial gate in accordance with the invention continues to furnish a reliable external closure and may readily be operated at high velocities of, e.g., 3 m/s. It is moreover suited for large gate widths.

Advantageous developments of the invention result from the features of subclaims 2 to 10.

It is thus, for example, also possible for the segments to be made translucent in a center region of the segment walls, with the segment walls comprising two profile members extending over the length of the segments and a translucent insert panel arranged between these, wherein the profile members each comprise a substantially U-shaped profile groove for receiving the longitudinal edges of the insert panel, and wherein one elastomer plastic element each is arranged between the longitudinal edges of the insert panel and the inner surface of the profile groove element in a press-fit, i.e., under deformation of the plastic element in comparison with the load-free state.

Thus it is, for example, also possible to make external gates of refrigerator rooms translucent over the entire gate body. This satisfies a wish frequently voiced by customers, for hereby the safety in handling the like industrial gates and in particular also with fast-moving industrial gates may be further increased. With such a design it is, for instance, possible for a forklift driver to ascertain, even while approaching the still-closed gate, whether something is present, or what is present on the other side of the gate.

A segment designed in this way has a low weight and may be manufactured cost-effectively. In addition, the width of the segment may moreover be varied simply through choice of the width of the insert panel, so that the industrial gate in accordance with the invention may have a dimensional proportion of the gate body adapted to the respective application.

With regard to further details and advantages of this preferred embodiment of the industrial gate in accordance with the invention, reference is made to the full disclosure of the copending U.S. patent application Ser. No. 10/119,596 (Atty. docket No. 02215/T6) corresponding to German patent application no. DE 10119242.8 filed Apr. 19, 2001 and entitled "Industrial gate, segment for an industrial gate, and method for manufacturing such a segment." It is incorporated herein by reference. The design described there in particular by way of the principle of single-walled segments may be transferred analogously to the respective segment wall of a double-walled segment, so that the latter may also be made translucent in a center region. The further designs explained in the mentioned parallel German patent application and the advantages that may be achieved through it may furthermore be realized with a double-walled segment, as partly also results from the following explanations for subclaims 3 to 10.

Thus the plastic element may be formed of EPDM, i.e., an ethylene-propylene rubber. This material has been found in trials to be particularly well suited for the purposes of the invention. In particular, this material has good resistivity against weathering and ozone and may reliably be employed at very different temperatures of use. In addition, the mechanical properties of this plastic material are also particularly well suited for materializing the purpose of the invention, i.e., reliable and stable coupling of the webs with the segment walls and of the insert panel with the profile members, respectively.

It is furthermore advantageous if the plastic element is pre-fabricated as a U-profile. This has the effect that the plastic element will reliably come to rest in the desired location and not become dislocated while the press-fit is being produced. This simplifies the production of the segments and increases the reliability of the industrial gate in accordance with the invention.

The legs of the U-profile-shaped plastic element may present a clearance between their free ends having a smaller dimension than the thickness of the webs or insert panel, respectively. This has the effect that the plastic element is present with even better stability on the web and on the insert panel, respectively. The elastomer plastic element may therefore fulfill its function even more reliably.

Owing to the circumstance that recesses are formed in the inner ranges of the legs of the U-shaped plastic element adjacent the transverse web, the plastic element may fit the edge of the webs or of the insert panel, respectively, more accurately. The recesses here ensure that the webs or the insert panel may be inserted as far as the transverse web of the plastic element, with the edges being engaged in the recesses at the edges of the webs or the longitudinal edges of the insert panel, respectively,. Indeterminate conditions in this range may thus be avoided better.

It is furthermore advantageous if the lateral surfaces of the U-shaped profile groove each comprise a toothing which preferably is oriented in parallel with the bottom surface of the U-shaped profile groove. Owing to this toothing, the retaining force in this location of connection may be increased further. At the same time, the toothing also permits a certain compensation of tolerances between the joined components. The segment having this structure thus presents an improved stability.

If one introduction bevel each is formed at the edges of the opening of the U-shaped profile groove, the elastomer plastic element may be inserted into the profile groove in a more simple and more secure manner. In particular, this introduction bevel controls stretching of the elastomer plastic element during the press-fitting process, so that this step may be performed with higher process security.

It is furthermore advantageous if the press-fit of the plastic element between the edges of the webs and the inner surface of the profile groove is such as to generate retaining forces against withdrawal of the web from the profile groove, while at the same time admitting a displacement of the webs relative to the segment walls in the longitudinal direction of the segment, or when the press-fit of the plastic element between the edges of the insert panel and the inner surface of the profile groove is such as to generate retaining forces against withdrawal of the insert panel from the profile groove, while at the same time admitting a displacement of the insert panel relative to the profile members in the longitudinal direction of the segment. As a result, this segment is even better suited for an industrial gate which serves as an external closure and thus is exposed to thermal influences such as, e.g., direct insolation. The different longitudinal expansion coefficients of the materials accordingly do not result in any internal stresses in the participating elements. Instead, the elastomer plastic element absorbs these expansion forces and, because of its elasticity, allows for a relative displacement in the longitudinal direction of the segment. The industrial gate in accordance with the invention may then reliably be employed even for very great gate widths of six meters and more.

In accordance with another aspect of the invention, a double-walled segment is furnished in accordance with claim 11, which is in particular suited for an industrial gate in accordance with the invention. This double-walled segment may be used as a component for refurnishing or modification or also as a replacement part for existing industrial gates. In this double-walled segment the segment walls are interconnected at their longitudinal edges through the intermediary of a respective web which is formed of a material having a lower heat conductivity than the material of the segment walls, so as to establish a thermal separation of the segment walls. At the longitudinal edges of the segment walls one substantially U-shaped profile groove each for receiving the edges of the webs is formed, and moreover one elastomer plastic element each is arranged between the edges of the webs and the inner surface of the profile groove in a press-fit, i.e., under deformation of the plastic element in comparison with the load-free state.

By means of this double-walled segment, it is possible to analogously achieve the advantages explained above by way of the industrial gate. Moreover it is also possible to carry out the above mentioned developments which then result in the corresponding advantages.

In accordance with yet another aspect of the invention, a method for manufacturing such a segment is furnished in accordance with claim 13. This method contains the steps of: positioning opposed edges of webs with respect to a respective U-shaped profile groove on the longitudinal edges of segment walls; arranging an elastomer plastic element each between the edges of the webs and the U-shaped profile groove; and bringing together the webs and the segment walls, with the elastomer plastic element being pressed therebetween and deforming in the process.

This method is characterized in that a segment having the desired properties may reliably be manufactured at high process security and comparatively small expense in terms of construction.

In a preferred embodiment, the method, especially for formation of the segment walls, may comprise the further steps: positioning opposed longitudinal edges of an insert panel with respect to a respective U-shaped profile groove on two profile members which extend over the length of each segment wall; arranging an elastomer plastic element each between the longitudinal edges of the insert panel and the U-shaped profile groove; and bringing together the insert panel and the profile members, with the elastomer plastic element being pressed therebetween and deforming in the process.

Hereby the advantages of the above addressed German patent application having attorney's file wrapper No. EF01K26 and deposited by the applicant on the same application date, may be attained analogously.

In another embodiment, the plastic element may be given the shape of a U-profile and be inserted on the respective longitudinal edge of the web or of the insert panel, respectively. Hereby the method may be simplified further and implemented with even higher process security.

BRIEF DESCRIPTION OF THE DRAWINGS

The invention will be explained in more detail hereinbelow by referring to the figures of the drawing, wherein.

DETAILED DESCRIPTION OF THE DRAWINGS

Figure 1:
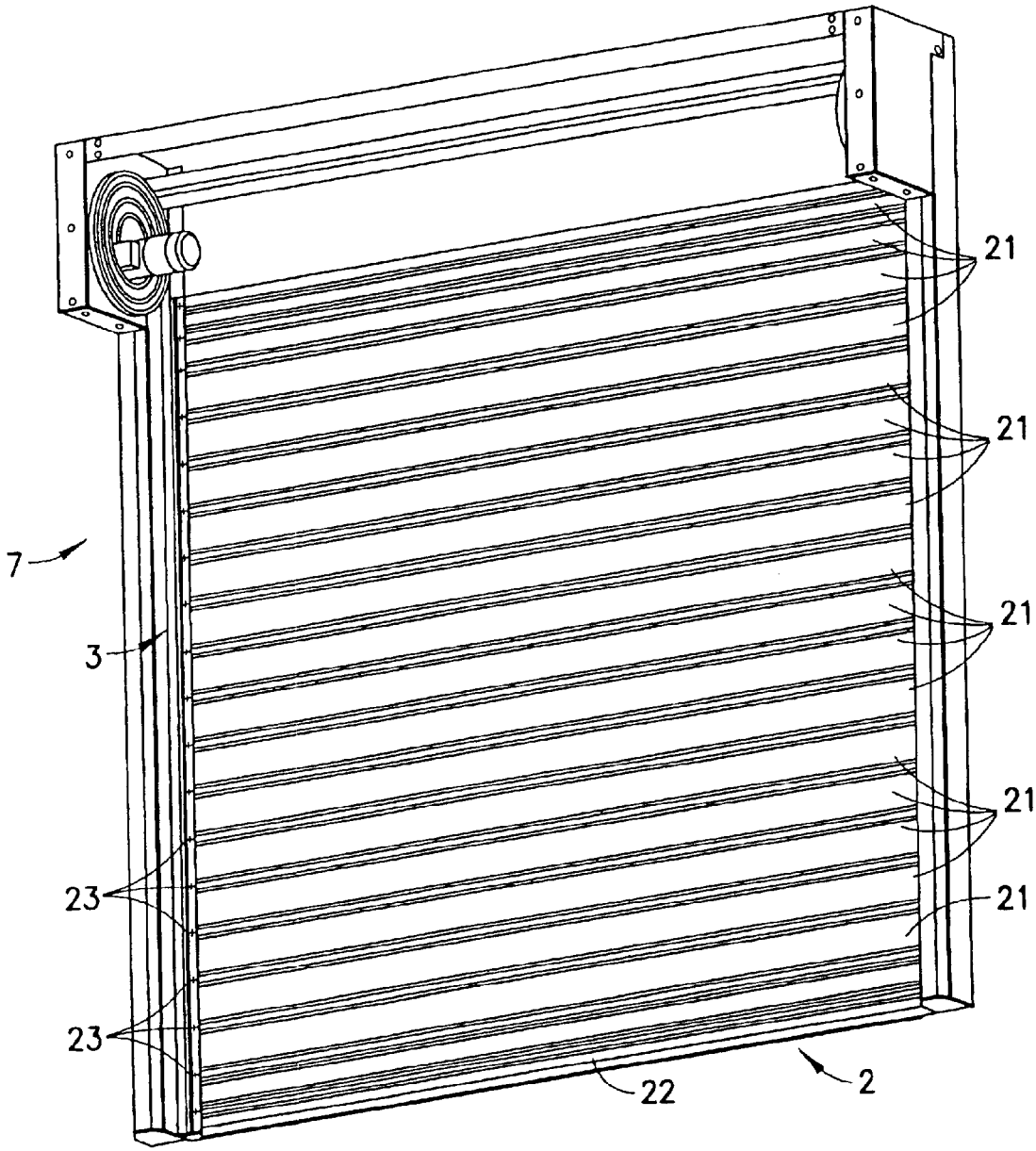
FIG. 1 is a schematic representation in perspective view of an industrial gate to which the invention is applicable.

In accordance with the representation in FIG. 1, an industrial gate 1 has a gate body 2 comprising a multiplicity of segments 21 which are interconnected such that they may be oriented at a relative angle, as well as a terminating profile 22 for floor-side termination. In FIG. 1, the industrial gate 1 is shown in the opened state in which the gate body 2 is wound into a spiral in the range of the lintel which is not represented.

The segments 21 are interconnected with the aid of hinge means not shown here; these hinge means may be single hinges between the segments, or also a strap hinge continuously extending over the height of the gate body in the ranges of the lateral edges of the gate body 2. In addition, at the lateral edges of the gate body 2 there are arranged in a known manner a plurality of rollers 23 which engage the guide rails 3 and serve for lateral guidance of the gate body 2.

Figure 2:
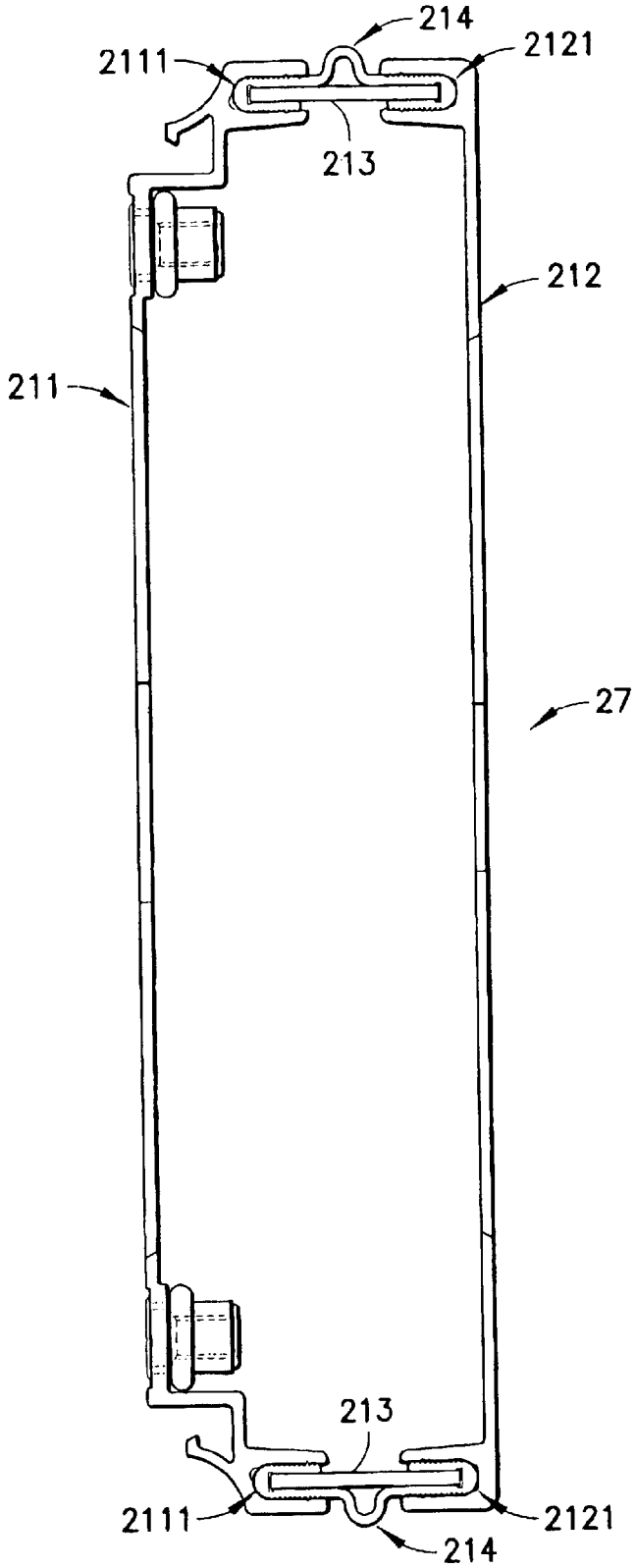
FIG. 2 is a sectional view of a segment of the invention in a first embodiment.

In accordance with the representation in FIG. 2, a segment 21 in a first embodiment comprises an inner segment wall 211 and an outer segment wall 212. These are interconnected in the range of their longitudinal edges through the intermediary of panel-type webs 213. The webs 213 engage U-shaped profile grooves 2111 and 2121 formed at the longitudinal edges of the segment walls 211 and 212 so as to face the respective other segment wall. Elastomer plastic elements 214 are furthermore arranged in a press-fit between the lateral edges of the webs 213 and the inner surfaces of the profile grooves 2111 and 2121.

Figure 3:
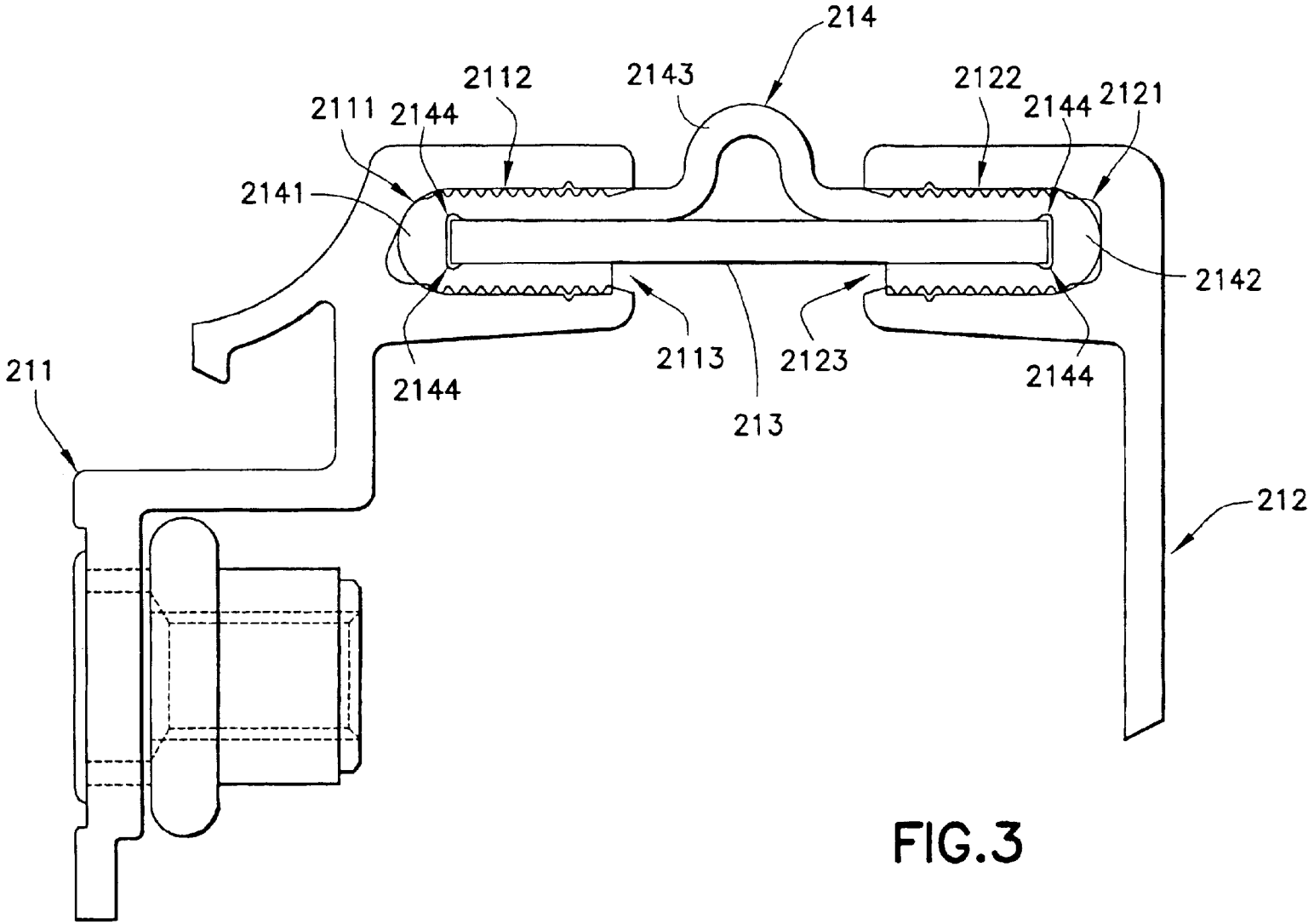
FIG. 3 is an enlarged detail in the range of a web from the representation of FIG. 2.

The connection thus established is shown in more detail in FIG. 3. As can be seen from this representation, the profile grooves 2111 and 2121 each comprise at their inner surfaces a toothing 2112 and 2122, the teeth of which are oriented substantially in parallel with the major surface of segment walls 211 and 212, i.e., crosswise to the direction of insertion. The profile grooves 2111 and 2121 are moreover provided on both sides of their open ends with introduction bevels 2113 and 2123.

The elastomer plastic element 214 comprises two U-profiles 2141 and 2142 each inserted on an edge of the web 213 and moreover interconnected through the intermediary of a connecting web 2143. Thus an integrally formed elastomer plastic element 214 serves as a connecting member at both locations of connection. As can furthermore be seen in FIG. 3, recesses 2144 are formed on both sides in the bottom range of the U-profiles 2141 and 2142, so that the U-profiles 2141 and 2142 may be fully inserted on the web 213.

In order to establish this connection, the elastomer plastic element 214 is at first inserted on the web 213. Then this structural unit is press-fitted in the profile grooves 2111 and 2121 at the segment walls 211 and 212. Hereby the U-profiles 2141 and 2142 of the plastic element 214 are deformed such that elastic stretching of the material takes place. Being guided by the introduction bevels 2113 and 2123, the plastic element 214 finally slides into the profile grooves 2111 and 2121. As soon as it has reached its final position, the plastic element 214 contracts again and becomes immobilized in the toothings 2112 and 2122, respectively. The plastic element 214 then remains in the profile grooves 2111 and 2121 while being lastingly deformed, so that the retaining force is also transmitted to the web 213.

Figure 4:
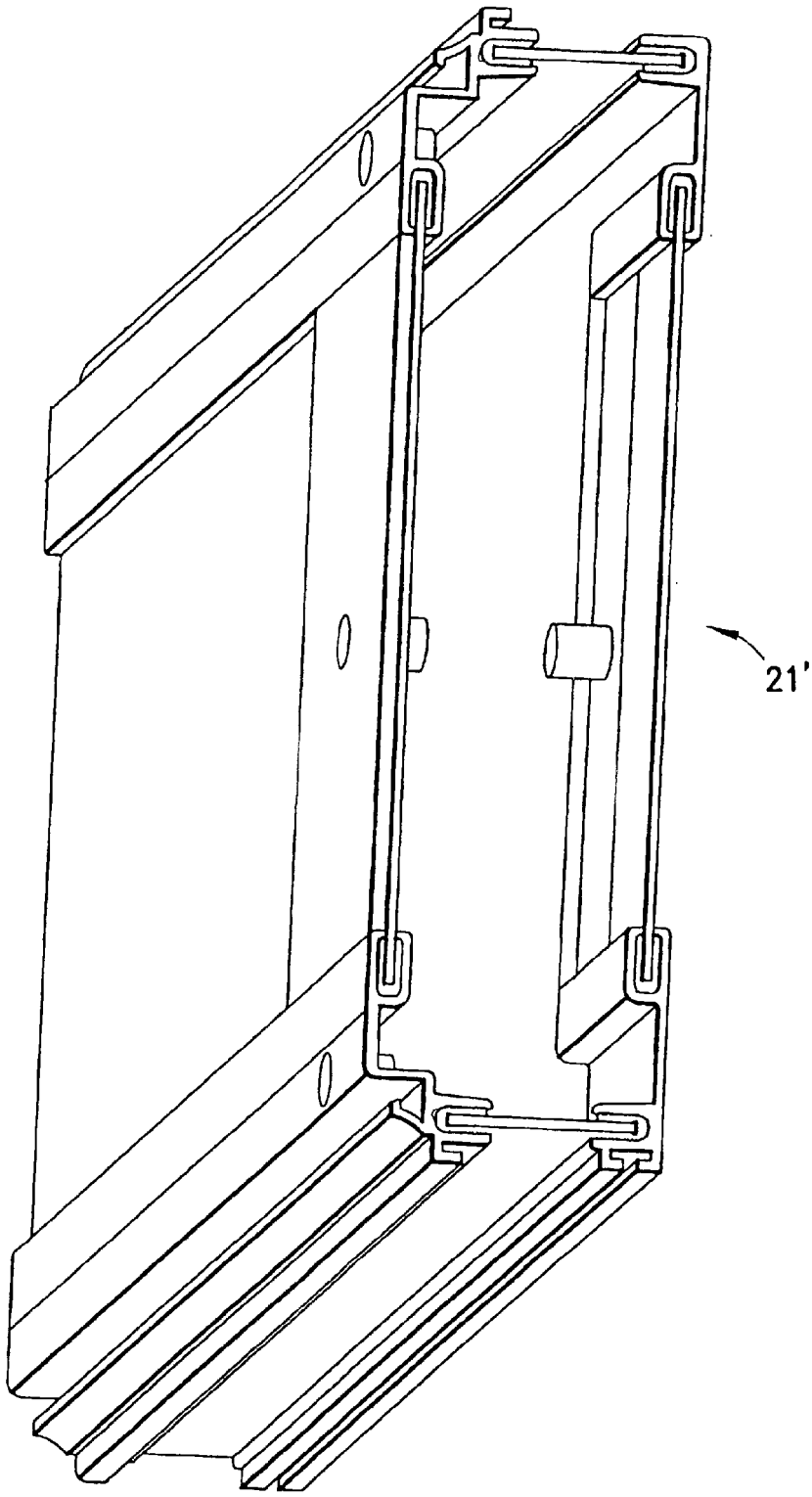
FIG. 4 is a representation in perspective view of a segment in accordance with a second embodiment.
Figure 5:
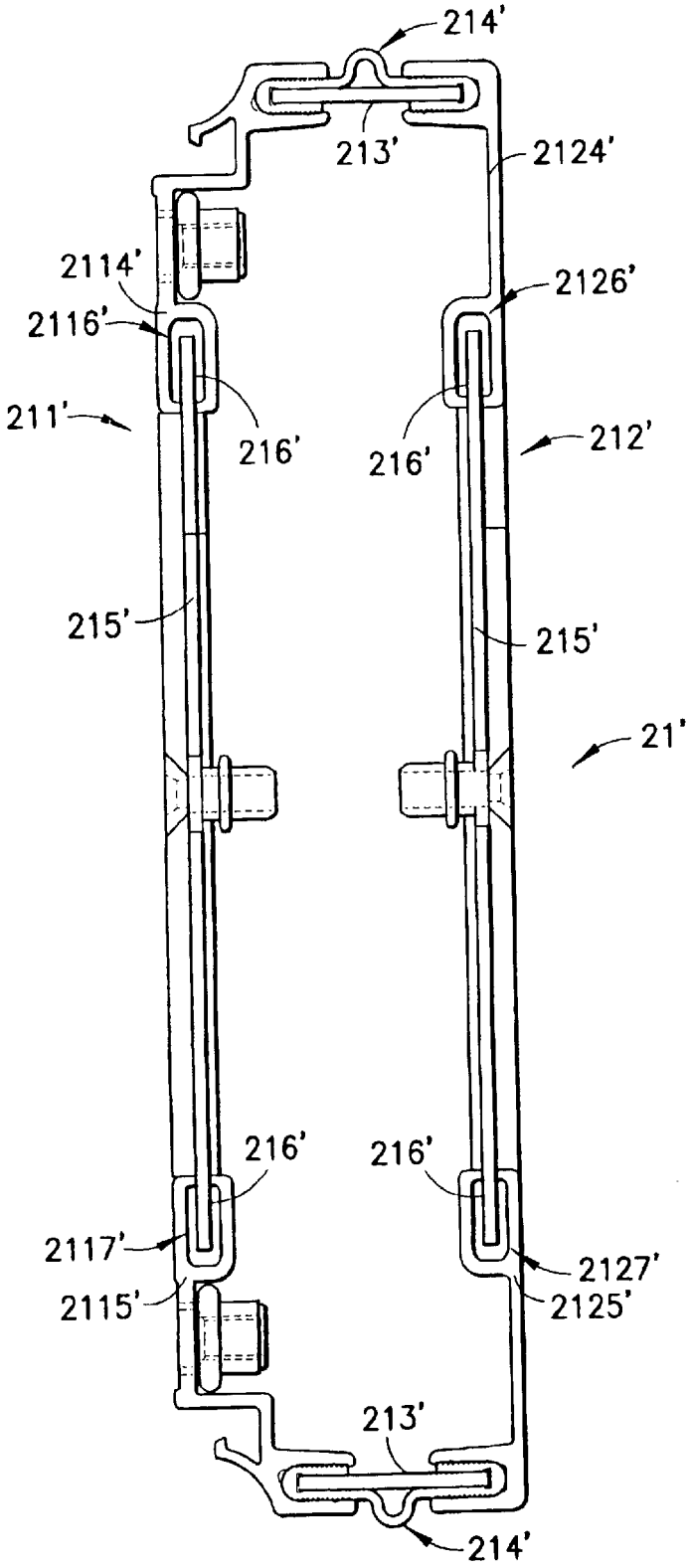
FIG. 5 is a front view of the segment in accordance with the second embodiment.

FIGS. 4 and 5 show a representation of another embodiment of a segment 21' according to the invention. This segment 21' also has an inner segment wall 211' and an outer segment wall 212' which are interconnected while thermally separated by means of webs 213' elastomer plastic elements 214' in a manner identical with the first embodiment.

In variation from the first embodiment, however, the segment walls are not formed integrally but each comprise two profile members 2114' and 2115' and 2124' and 2125', respectively, extending over the length of the segment 21', between which a respective insert panel 215' is arranged. This insert panel is formed to be translucent and consists of PMMA, for example. To this end, respective profile grooves 2116' and 2117' and 2126' and 2127', respectively, are formed in the profile members, wherein the insert panels 215' are engaged. Between the longitudinal edges of the insert panel 215' and the inner surface of the profile grooves 2116', 2117', 2126' and 2127' moreover one respective elastomer plastic element 216' is arranged in a press-fit.

In analogy with the design of the profile grooves 2111 and 2121 in the first embodiment, the profile grooves 2116', 2117', 2126' and 2127' are each formed with an internal toothing and an introduction bevel.

Figure 6:
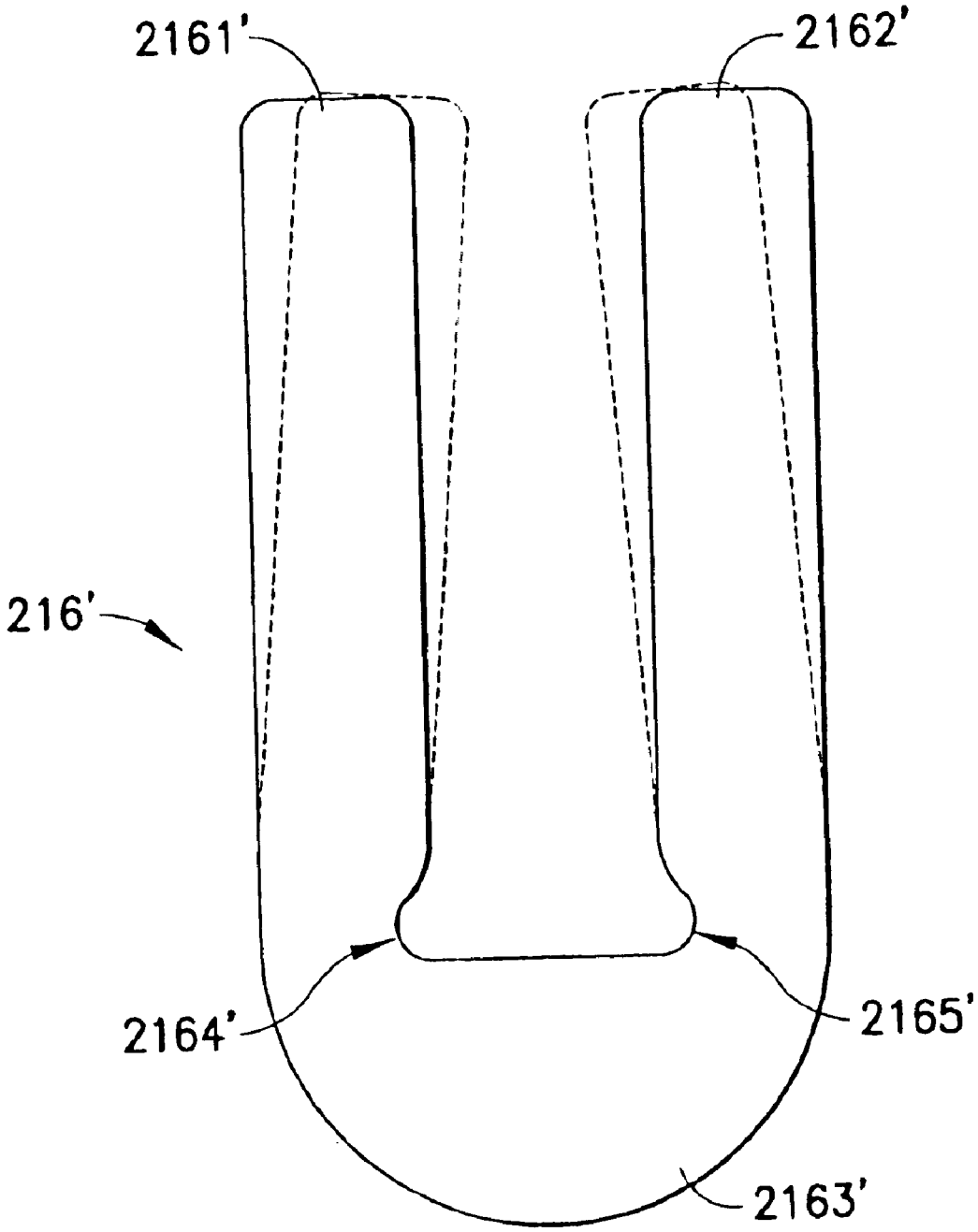
FIG. 6 shows one embodiment of an elastomer plastic element.

In FIG. 6, an elastomer plastic element 216' is moreover shown in more detail. It has the form of a U-profile and comprises legs 2161' and 2162' interconnected by a transverse web 2163'. The plastic element 216' thus prefabricated is furthermore provided with recesses 2164' and 2165' on the inside in the range of the transverse web 2163'.

In FIG. 6 the state before assembly of the plastic element 216' is additionally indicated by a broken line, according to which the clearance of the free ends of the legs 2161' and 2162' has a smaller dimension than the thickness of the insert panel 215'. In the inserted condition, the plastic element 216' thus comes to lie against the insert panel 215' in the position shown by a solid line.

In analogy with the kind of connection in the range of the webs 213' it is thereby also possible to produce a stable connection within the segment walls 211' and 212', so the segment 21' is equally suited for burglar-proof external gates. In addition, a gate body provided with the segments 21' may also be made translucent largely over its entire height. It is moreover also possible to vary the width of the segment 21', i.e., the dimensional proportion of the gate body, through choice of the width of the insert panel 215'.

The web or the insert panels, respectively, are thus clamped fixedly and yet furthermore elastically in the profile grooves. As a result, a very high retaining force—a typical amount is about 300 N/dm—against withdrawal of the webs or of the insert panel, respectively, is attained on the one hand, and yet a displacement of the webs or insert panel relative to the segment walls or the profile members particularly in the longitudinal direction of the segment is possible on the other hand, so that internal stresses owing to a different expansion of the materials under thermal influences may be avoided. In practical trials it has been found that the elasticity of the plastic element is overcome from a certain point, with a (reversible) sliding displacement taking place at the boundary surfaces. This sliding displacement occurs where the friction is lowest, such as, e.g., between the insert panel or the web on the one hand and the elastomer plastic element on the other hand.

It accordingly is possible to combine most different materials, with aluminum or an aluminum alloy such as AlMgSi 0.5 F22 or also a plastic such as a GFRP or PMMA being preferably used for the segment walls or the profile members. It moreover is also possible for the webs or the insert panel to be formed, e.g., of transparent PMMA or also of another plastic such as, e.g., PVC or PC.

Besides the embodiments presently set forth, the invention allows for further design approaches.

The insert panels and/or the webs may as an alternative also be designed as multi-layered elements, e.g., in sandwich construction, so as to achieve, e.g., an additional heat-insulation effect.

Figure 7:
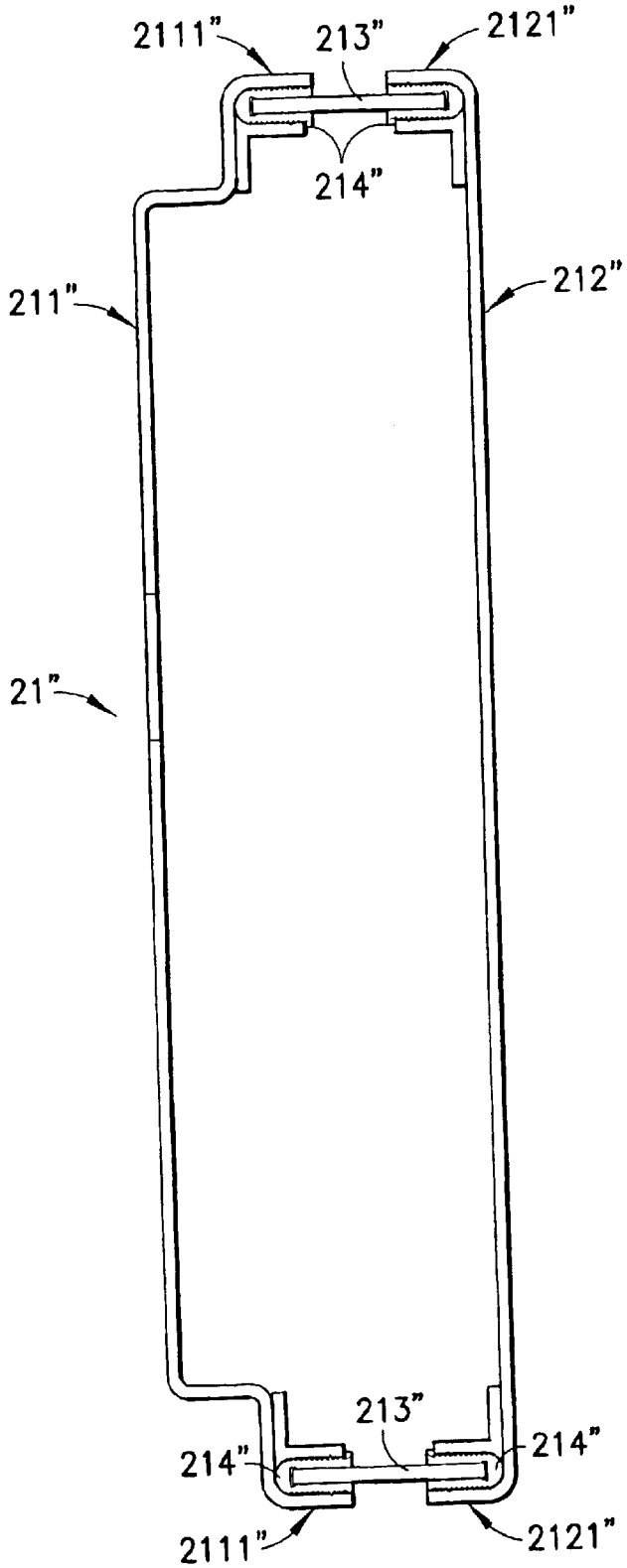
FIG. 7 is a sectional view of a segment in accordance with a third embodiment.

It is moreover possible to form grooves 2111" and 2121" in a segment 21", as shown in FIG. 7, not by integrally forming them in segment walls 211" and 212", but through mechanical connection of several elements. Care should, however, be taken here to observe narrow tolerances in order to furthermore achieve the desired press-fit of the plastic elements 214" or of the webs 213", respectively.

Figure 8:
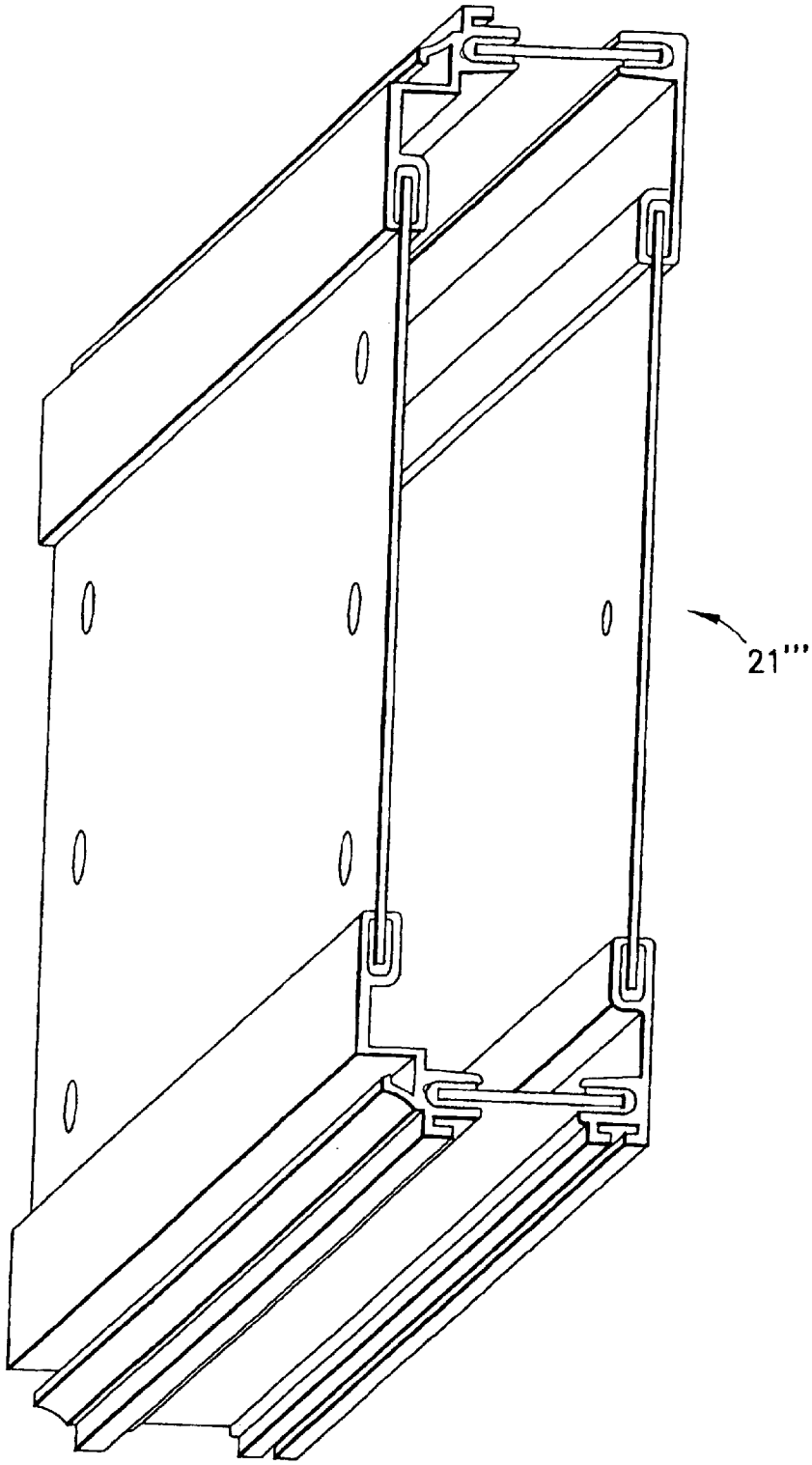
FIG. 8 is a representation in perspective view of a segment in accordance with another embodiment.

In accordance with the representation in FIG. 8, it is also possible to arrange two U-profile-shaped plastic elements in the range of the webs of a segment 21'" instead of the one-piece elastomer plastic element 214 or 214', respectively.

The plastic element may also be formed of an elastomer other than EPDM. One example herefor, besides NBR, CR, TPE and EPM, also is a butyl rubber or neoprene-polychloroprene.

The plastic element moreover need not be pre-fabricated as a U-profile but may also be supplied as a planar body, to be positioned in a central position between the profile groove and the edge of the web or of the insert panel, respectively, and then press-fitted. It is furthermore not necessary for the free ends of the legs of the plastic element to have a clearance smaller than the thickness of the web or of the insert panel, respectively. It is equally possible to omit the recesses.

In accordance with the invention, it is possible to do without bonding at the locations of connection. In particular applications it is, however, also possible to additionally provide single bonding points or even continuous bonding in the profile groove in order to enhance the retaining force of the connection.

It is furthermore also possible to form the profile grooves without a toothing and/or also without an introduction bevel. The border areas of the insert panels or webs co-operating with the plastic elements may furthermore be provided with friction-increasing means such as, e.g., a coating or a surface structure (fluting or ribbing).

The segments 21, 21' or 21" may furthermore also be filled with an insulating foam material such as PS. Hereby, for example with a segment having the dimensions 225 mm×60 mm, a heat transfer coefficient k=0.7 W/($m^2$K) in accordance with German Industrial Standard [DIN] 4108-5 may be attained.

It is furthermore also possible to provide the segment with more than two segment walls, i.e., to introduce a third wall or further walls as an intermediate wall so as to furnish a multi-layered structure of the segment providing several chambers. These may then partly be filled with insulating foam, wherein it is also possible to arrange various insulation materials, including non-flammable ones such as mineral wool, in the single chambers.

In addition, in practical testing a comparative test with regard to the flexure of a conventional segment with a directly press-fitted web in comparison with a segment of the invention was carried out under one-sided temperature influence. At system dimensions of 225 mm×60 mm, the segments had a length of 3 meters. The measurement results are represented in the following Table:

| Temperature difference Inside/Outside [K] | Flexure of the segment of the invention [mm] | Flexure of the conventional segment [mm] |
|---|---|---|
| 0 | 0 | 0 |
| 5 | 4 | 12 |
| 10 | 7 | 20 |
| 15 | 11 | 28 |
| 20 | 14 | 34 |
| 25 | 16 | 39 |
| 30 | 18 | 44 |
| 35 | 21 | 49 |
| 40 | 23 | 55 |
| 45 | 25 | 59 |
| 50 | 27 | 64 |
| 55 | 29 | 68 |
| 60 | 31 | 72 |
| 65 | 32 | 77 |
| 70 | 33 | 83 |
| 75 | 34 | 88 |
| 80 | 35 | 94 |

Figure 9:
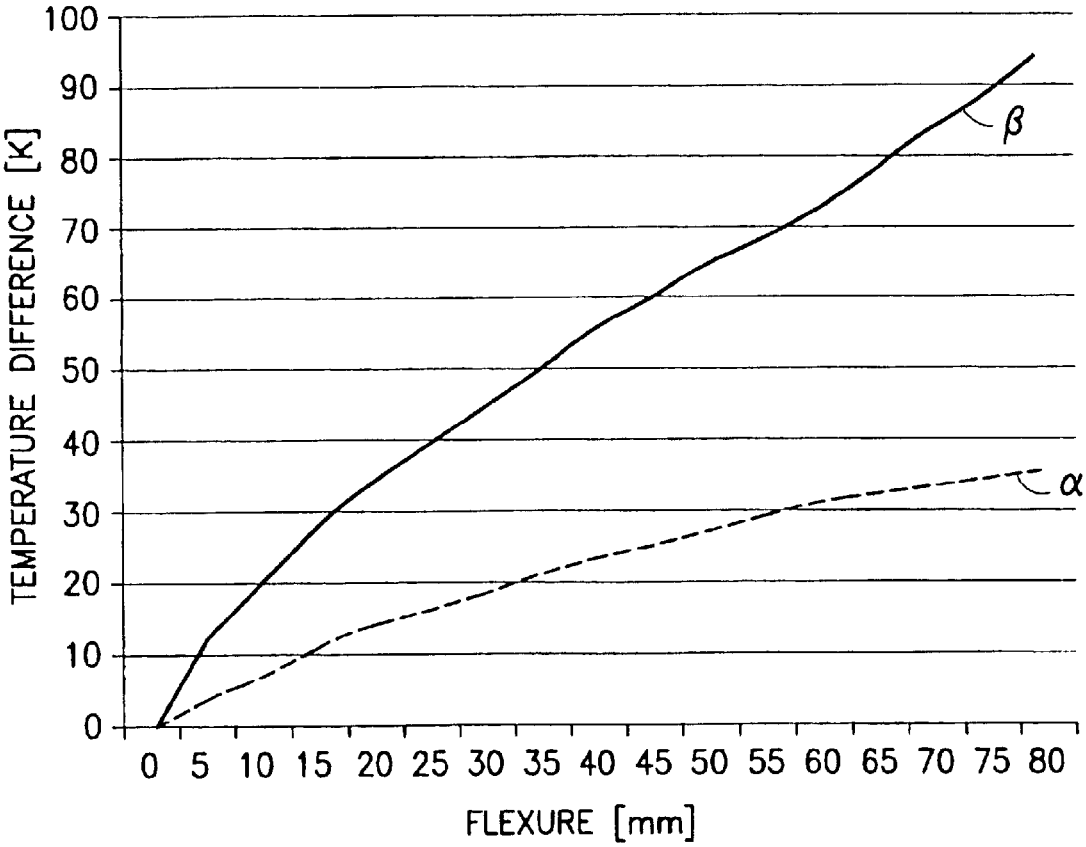
FIG. 9 is a graph representing a comparison of the flexure of a conventional segment and of a segment according to the invention under the influence of temperature.

FIG. 9 shows the result of this test in graphic representation and demonstrates that the segment of the invention (α) undergoes a substantially smaller deformation than the conventional segment (β). As a reason for this it is assumed that the elastomer plastic element admits a sliding displacement in the longitudinal direction of the segment at the boundary surfaces as soon as the elasticity of the plastic element is overcome. In the segment of the invention, a compensatory movement among the members of the segment is accordingly possible, whereby the tensions occurring as a result of the temperature differences may partly be eliminated. This process is reversible, which means that the flexure may be offset as soon as the inside and outside temperatures become equal again.

What is claimed is:

1. An industrial gate (1) for covering a gateway, comprising:

a plurality of double-walled segments (21, 21', 21") hingeably interconnected such that adjacent segments can be oriented at an angle relative to each other;

a plurality of webs (213, 213' 213") each interconnecting facing, longitudinal edges of inner and outer walls of one of said double-walled segments, with opposed longitudinal edges of said web being respectively accommodated in substantially U-shaped profile grooves (2111, 2121, 2111", 2121") extending along the longitudinal edges of said inner and outer walls, said web being comprised of a material having a lower conductivity than a material constituting said inner and outer segment walls so as to establish a thermal separation of said inner and outer segment walls; and a plurality of elastomer plastic elements (214, 214', 214") press-fit in a deformed state between the longitudinal edge of one of said webs and the inner surface of said respective U-shaped profile groove in which it is accommodated.

2. Industrial gate in accordance with claim 1, wherein said inner and outer segment walls (211', 212) each comprise two profile members (2114', 2115', 2124', 2125) extending over the length of said segments (21) and an insert panel (215) arranged between said profile members, wherein said profile members (2114', 2115', 2124', 2125) each comprise a substantially U-shaped profile groove (2116', 2117', 2126', 2127) for receiving respective longitudinal edges of said insert panel (215), and wherein one elastomer plastic element (216) is press fit in a deformed state between the longitudinal edge of said insert panel (215) and the inner surface of said profile groove (2116', 2117', 2126', 2127) in which it is received.

3. Industrial gate in accordance with claim 2, characterized in that sizing of said plastic element relative to said profile groove is such that the press-fit of said plastic element (216') between the edge of said insert panel (215') and the inner surface of said profile groove in which it is received (2116', 2117', 2126', 2127') is such as to generate retaining forces against withdrawal of said insert panel (215') from said profile groove (2116', 2117', 2126', 2127'), while at the same time enabling a displacement of said insert panel (215') relative to said profile members (2114', 2115', 2124', 2125') in the longitudinal direction of said segment (21').

4. Industrial gate in accordance with claim 2, characterized in that each said plastic element received in said insert panels has a U-profile, when in a relaxed, non-deformed state, and wherein legs of said U-profile-shaped plastic element present a clearance between their free ends having a smaller dimension than the thickness of said insert panel.

5. Industrial gate in accordance with claim 2, wherein at least a portion of said profile members is translucent.

6. Industrial gate in accordance with claim 1, characterized in that said plastic element (214, 214', 214"; 216') is composed of an ethylene propylene diene monomer (EPDM).

7. Industrial gate in accordance with claim 1, characterized in that said plastic element (214, 214', 214"; 216') has a U-profile shape when in a relaxed, non-deformed state.

8. Industrial gate in accordance with claim 7, characterized in that legs (2161', 2162") of said U-profile-shaped plastic element (216') present a clearance between their free ends, said clearance having a smaller dimension than the thickness of said webs (213").

9. Industrial gate in accordance with claim 7, characterized in that recesses (2164', 2165") are formed at inner ranges of said legs (2161', 2162") of said U-profile-shaped plastic element (216') adjacent said web (2163').

10. Industrial gate in accordance with claim 1, characterized in that lateral surfaces of said U-shaped profile groove (2111, 2122; 2116', 2117'; 2126', 2127') each comprise a toothing (2112, 2122) oriented in parallel with a bottom surface of said U-shaped profile groove (2111, 2122; 2116', 2117'; 2126', 2127').

11. Industrial gate in accordance with claim 1, characterized in that an introduction bevel (2113, 2123) is formed at edges of an opening of said U-shaped profile groove (2111, 2121).

12. Industrial gate in accordance with claim 1, characterized in that sizing of said plastic element relative to said profile groove is such that the press-fit of said plastic element (214, 214', 214") between the edge of said web (213; 213'; 213") and the inner surface of said profile groove in which it is received (2111, 2121; 2111", 2121") is such as to generate retaining forces against withdrawal of said web (213; 213'; 213") from said profile groove (2111, 2121; 2111", 2121"), while enabling a displacement of said web (213; 213'; 213") relative to said segment walls (211, 212; 211', 212'; 211', 212") in the longitudinal direction of said segment (201; 21'; 21").

13. A double-walled segment for an industrial gate to cover a gateway, comprising:

an inner wall and an outer wall;

a web interconnecting facing longitudinal edges of said inner and outer walls, with opposed longitudinal edges of said web being respectively accommodated in substantially U-shaped profile grooves extending along the longitudinal edges of said inner and outer walls, said web being comprised of a material having a lower conductivity than a material constituting said inner and outer segment walls so as to establish a thermal separation of said inner and outer segment walls; and an elastomer plastic element press-fit in a deformed state between the longitudinal edge of said web and the inner surface of said profile groove in which it is accommodated.

14. A double-walled segment for an industrial gate in accordance with claim 13, wherein said inner and outer segment walls each comprise two profile members extending over the length of said segments and an insert panel arranged between said profile members, wherein said profile members each comprise a substantially U-shaped profile groove for receiving respective opposed longitudinal edges of said insert panel, and wherein an elastomer plastic element is press fit in a deformed state between the longitudinal edge of said insert panel and the respective inner surface of said profile groove in which it is received.

15. A method for manufacturing a segment in accordance with claim 14, wherein said inner and outer segment walls are constructed by the steps of:

positioning said opposed longitudinal edges of said insert panel relative to said respective U-shaped profile grooves on two profile members which extend over the length of each said segment wall;

arranging said elastomer plastic element between each of the longitudinal edges of said insert panel and said respective U-shaped profile grooves; and bringing together said insert panel and said profile members such that said elastomer plastic element is deformably pressed therebetween.

16. A method for manufacturing a segment in accordance with claim 15, wherein said plastic element is formed to have a U-shaped profile, and one said plastic element is inserted on each of the opposed longitudinal edges of said insert panel.

17. A method for manufacturing a segment in accordance with claim 13, comprising the steps of:

positioning the opposed longitudinal edges of said web relative to said respective U-shaped profile grooves on the longitudinal edges of said inner and outer segment walls;

arranging said elastomer plastic element between each of the opposed longitudinal edges of said web and said respective U-shaped profile grooves; and bringing together said web and said inner and outer segment walls such that said elastomer plastic element is deformably pressed therebetween.

18. A method for manufacturing a segment in accordance with claim 17, wherein said plastic element is formed to have a U-shaped profile, and one said plastic element is inserted on each of the opposed longitudinal edges of said web.

* * * * *